US007185960B2

(12) United States Patent
Farr

(10) Patent No.: US 7,185,960 B2
(45) Date of Patent: Mar. 6, 2007

(54) PRINTING DEVICE HAVING A PRINTING FLUID DETECTOR

(75) Inventor: Isaac Farr, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 166 days.

(21) Appl. No.: 10/632,081

(22) Filed: Jul. 30, 2003

(65) Prior Publication Data

US 2005/0024396 A1 Feb. 3, 2005

(51) Int. Cl.
*B41J 29/38* (2006.01)
*B41J 2/17* (2006.01)

(52) U.S. Cl. ..... 347/7; 347/84

(58) Field of Classification Search ..... 347/7, 347/14, 19, 84, 85, 86, 87; 73/304 C, 304 R; 340/620

See application file for complete search history.

(56) References Cited

U.S. PATENT DOCUMENTS 3,757,134 A * 9/1973 Whitener ..... 307/118
3,777,257 A * 12/1973 Geisselmann ..... 324/663
4,122,718 A * 10/1978 Gustafson ..... 73/304 C
4,166,388 A * 9/1979 Sun et al. ..... 73/304 R
4,188,826 A * 2/1980 Kankura et al. ..... 73/304 R
4,276,128 A * 6/1981 Nishino et al. ..... 205/200
4,319,484 A 3/1982 Keller
4,800,755 A 1/1989 Fathauer et al.
4,841,256 A 6/1989 Gastgeb
4,956,763 A 9/1990 Stewart, Jr. et al.
4,973,993 A * 11/1990 Allen ..... 347/7
5,033,300 A * 7/1991 Matsuo et al. ..... 73/304 R
5,097,248 A * 3/1992 Kumada et al. ..... 338/80
5,289,211 A * 2/1994 Morandotti et al. ..... 347/7
5,307,678 A * 5/1994 Cost ..... 73/304 C
5,494,562 A * 2/1996 Maley et al. ..... 257/414
5,611,240 A 3/1997 Yamaguchi
5,719,556 A 2/1998 Albin et al.
5,747,689 A * 5/1998 Hampo et al. ..... 73/304 C
5,821,309 A * 10/1998 Oka ..... 525/540
6,007,173 A * 12/1999 DeLouise et al. ..... 347/7
6,084,605 A 7/2000 Yaji
6,183,054 B1 2/2001 Froger
6,246,831 B1 6/2001 Seitz et al.
6,286,921 B1 * 9/2001 Ochi et al. ..... 347/7
6,820,483 B1 * 11/2004 Beckerman ..... 73/304 C
6,827,411 B2 * 12/2004 Kubota et al. ..... 347/7
6,871,925 B2 * 3/2005 Yamamoto et al. ..... 347/6
6,936,761 B2 * 8/2005 Pichler ..... 136/256
2002/0109758 A1 * 8/2002 Kono ..... 347/85
2004/0223021 A1 * 11/2004 Farr et al. ..... 347/19

FOREIGN PATENT DOCUMENTS

EP 0 509 747 10/1992
EP 0 672 528 9/1995
EP 1 125 748 8/2001
JP 04244853 A * 9/1992
JP 04282256 A * 10/1992
JP 06286160 A * 10/1994
JP 2000 296614 10/2000

* cited by examiner

*Primary Examiner*—Stephen Meier
*Assistant Examiner*—Leonard Liang

(57) ABSTRACT

A printing device is provided, wherein the printing device is configured to print a printing fluid onto a printing medium. The printing device includes a printing fluid reservoir configured to hold a volume of the printing fluid, a print head assembly configured to transfer the printing fluid to the printing medium, wherein the print head assembly is fluidically connected to the printing fluid reservoir, and a printing fluid detector configured to detect a characteristic of the printing fluid. The printing fluid detector includes a first electrode and a second electrode configured to be in contact with the printing fluid, wherein at least one of the first electrode and the second electrode includes an electrically conductive coating disposed over an electrically conductive substrate.

14 Claims, 4 Drawing Sheets

PRINTING DEVICE HAVING A PRINTING FLUID DETECTOR

BACKGROUND

Many types of printing devices, including but not limited to printers, copiers, and facsimile machines, print by transferring a printing fluid onto a printing medium. These printing devices typically include a printing fluid supply or reservoir configured to store a volume of printing fluid. The printing fluid reservoir may be located remotely from the print head assembly ("off-axis"), in which case the fluid is transferred to the print head assembly through a suitable conduit, or may be integrated with the print head assembly ("on-axis"). Where the printing fluid reservoir is located off-axis, the print head assembly may include a small reservoir that is periodically refilled from the larger off-axis reservoir.

Some printing devices may include a printing fluid detector configured to produce an out-of-fluid signal when printing fluid in the print head assembly or printing fluid reservoir drops below a predetermined level. This signal may be used to trigger the printing device to stop printing, and also to alert a user to the out-of-fluid state. The user may then replace (or replenish) the printing fluid reservoir and resume printing.

Various types of printing fluid detectors are known. Examples include, but are not limited to, optical detectors, pressure-based detectors, resistance-based detectors and capacitance-based detectors. Capacitance-based printing fluid detectors may utilize a pair of capacitor plates positioned adjacent, but external, to the printing fluid. These detectors measure changes in the capacitance of the plates with changes in printing fluid levels. However, the changes in capacitance of these systems may be too small to easily distinguish the capacitance changes from background noise. Thus, it may be difficult to accurately determine a printing fluid level, resulting in the generation of false out-of-fluid signals, and/or the failure to generate out-of-fluid signals when appropriate. Furthermore, many capacitance- and resistance-based detectors may have difficulty distinguishing printing fluid from printing fluid froth, which is commonly found in a printing fluid reservoir after the reservoir is substantially emptied of printing fluid.

SUMMARY

A printing device is provided, wherein the printing device is configured to print a printing fluid onto a printing medium. The printing device includes a printing fluid reservoir configured to hold a volume of the printing fluid, a print head assembly configured to transfer the printing fluid to the printing medium, wherein the print head assembly is fluidically connected to the printing fluid reservoir, and a printing fluid detector configured to detect a characteristic of the printing fluid. The printing fluid detector includes a first electrode and a second electrode configured to be in contact with the printing fluid, wherein at least one of the first electrode and the second electrode includes an electrically conductive coating disposed over an electrically conductive substrate.

DETAILED DESCRIPTION

Figure 1:
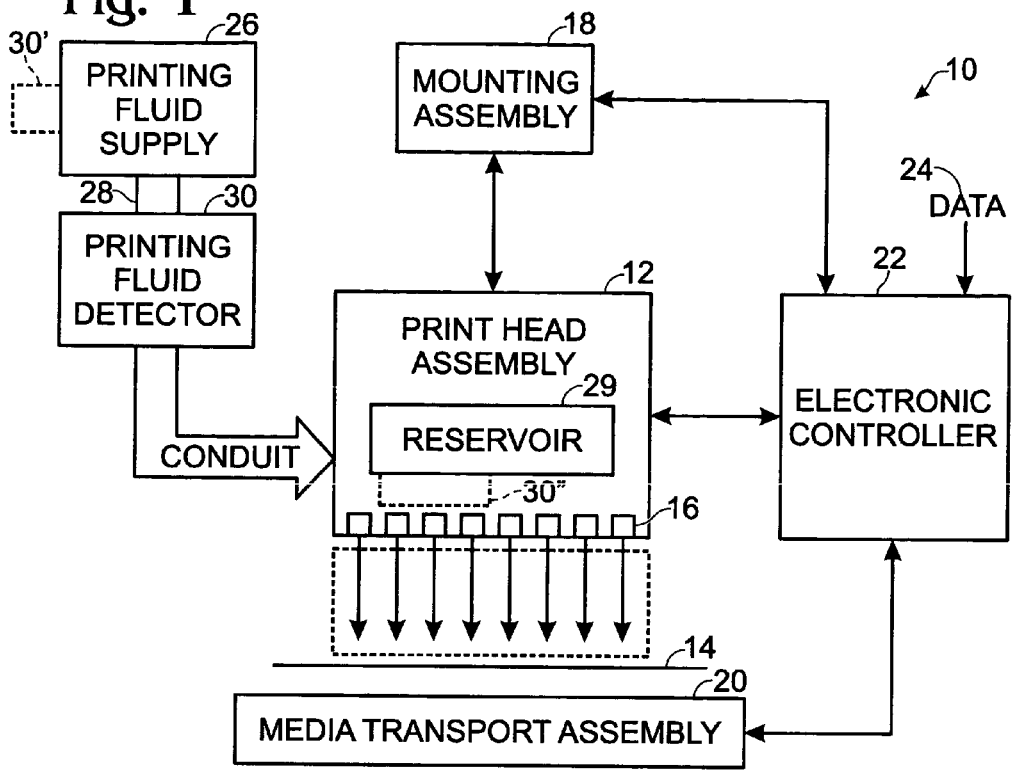
FIG. 1 is a block diagram of a printing device according to a first embodiment of the present invention.

FIG. 1 shows, generally at 10, a block diagram of a first embodiment of a printing device according to the present invention. Printing device 10 may be any suitable type of printing device, including but not limited to, a printer, facsimile machine, copier, or a hybrid device that combines the functionalities of more than one of these devices. Printing device 10 includes a print head assembly 12 configured to transfer a printing fluid onto a printing medium 14 positioned adjacent to the print head assembly. Print head assembly 12 typically is configured to transfer the printing fluid onto printing medium 14 via a plurality of fluid ejection mechanisms 16. Fluid ejection mechanisms 16 may be configured to eject printing fluid in any suitable manner. Examples include, but are not limited to, thermal and piezoelectric fluid ejection mechanisms.

Print head assembly 12 may be mounted to a mounting assembly 18 configured to move the print head assembly relative to printing medium 14. Likewise, printing medium 14 may be positioned on, or may otherwise interact with, a media transport assembly 20 configured to move the printing medium relative to print head assembly 12. Typically, mounting assembly 18 moves print head assembly 12 in a direction generally orthogonal to the direction in which media transport assembly 20 moves printing medium 14, thus enabling printing over a wide area of printing medium 14.

Printing device 10 also typically includes an electronic controller 22 configured receive data 24 representing a print job, and to control the ejection of printing fluid from print head assembly 12, the motion of mounting assembly 18, and the motion of media transport assembly 20 to effect printing of an image represented by data 24.

Printing device 10 also includes a printing fluid supply or reservoir 26 configured to supply printing fluid stored within the printing fluid reservoir to print head assembly 12 as needed. Printing fluid reservoir 26 is fluidically connected to print head assembly 12 via a conduit 28 configured to transport printing fluid from the printing fluid reservoir to the print head assembly. Any of print head assembly 12, printing fluid reservoir 26, or conduit 28 may include a suitable pumping mechanism (not shown) for effecting the transfer of printing fluid from the printing fluid reservoir to the print head assembly. Examples of suitable pumping devices include, but are not limited to, peristaltic pumping devices.

Printing fluid reservoir 26 may be configured to deliver printing fluid to print head assembly 12 continuously during printing, or may be configured to deliver a predetermined volume of printing fluid to the print head assembly periodically. Where printing fluid reservoir 26 is configured to deliver a predetermined volume of printing fluid to print head assembly 12 periodically, the print head assembly may include a smaller reservoir 29 configured to hold printing fluid transferred from printing fluid reservoir 26.

Printing device 10 also includes a printing fluid detector 30. Printing fluid detector 30 is configured to measure an impedance value associated with the printing fluid, and to determine a characteristic of the printing fluid based upon the measured impedance value. For example, printing fluid detector 30 may be configured to distinguish between printing fluid, printing fluid froth and air to generate an out-of-fluid signal when froth or air is detected, to detect a printing fluid level in printing fluid reservoir 26 or smaller reservoir 29, or to determine a type of printing fluid currently in use in printing device 10.

Printing fluid detector 30 may be positioned in any of a number of locations on printing device 10. For example, printing fluid detector may be disposed along conduit 28 between printing fluid reservoir 26 and print head assembly 12. In this location, printing fluid detector 30 may be configured to determine a characteristic of the printing fluid within conduit 28. Alternatively, printing fluid detector 30 may be associated with printing fluid reservoir 26, as indicated at 30', or with smaller reservoir 29, as indicated at 30", to detect a presence/absence, level, or type of printing fluid in these structures.

Figure 2:
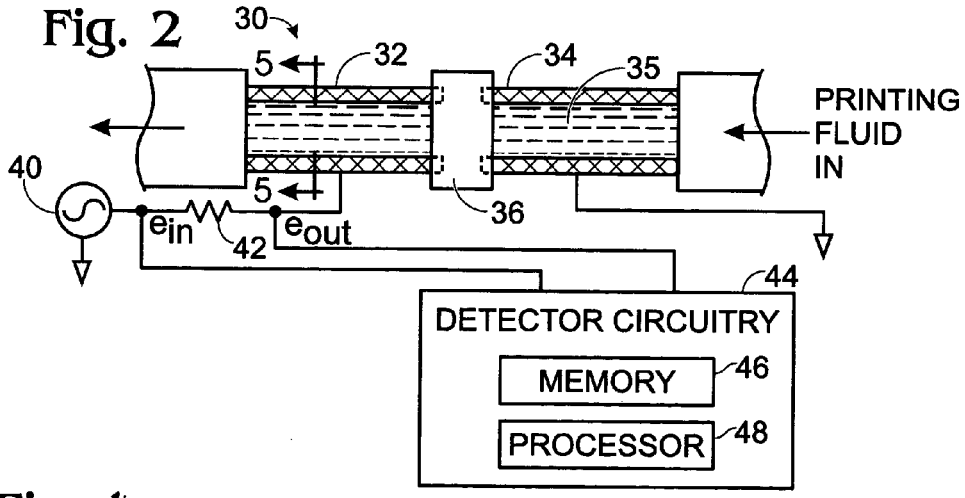
FIG. 2 is a schematic depiction of a first exemplary embodiment of the printing fluid detector of the printing device of FIG. 1.

FIG. 2 shows a schematic depiction of a first exemplary embodiment of printing fluid detector 30, which is configured to be disposed along conduit 28. Printing fluid detector 30 includes a first electrode 32 and a second electrode 34. Each electrode has a hollow interior through which printing fluid may flow, and solid walls configured to contain the printing fluid within the hollow interior. Thus, each electrode forms a portion of conduit 28.

First electrode 32 and second electrode 34 are each electrically conductive, and are separated from each other by an electrically insulating conduit segment 36. First electrode 32 and second electrode 34 are arranged in the conduit such that printing fluid 35 flowing from printing fluid reservoir 26 into print head assembly 12 first flows through one of the electrodes, then through electrically insulating conduit segment 36, and then through the other electrode before reaching the print head assembly. In FIG. 2, printing fluid is depicted as flowing first through second electrode 34. However, it will be appreciated that printing fluid may also flow first through first electrode 32.

Printing fluid detector 30 also includes power supply circuitry 40 configured to apply an alternating signal to the first electrode or second electrode (or, equivalently, across the first and second electrodes). A resistor 42 is disposed between power supply circuitry 40 and first electrode 32, in series with first electrode 32 and second electrode 34.

Additionally, printing fluid detector 30 includes detector circuitry 44 configured to determine a measured impedance value of the printing fluid from a comparison of the supply signal $e_{in}$ and a detected signal $e_{out}$. As shown in FIG. 2, $e_{in}$ may be measured at the power supply side of resistor 42, and $e_{out}$ may be measured at the side of resistor 42 closer to first electrode 32. Alternatively, $e_{in}$ and $e_{out}$ may be measured at any other suitable location where the one signal is altered from the other by the impedance of the printing fluid. The measured impedance value, either a capacitance value or a resistance value, may then be used to determine a characteristic of printing fluid 35 in printing fluid reservoir 26, including but not limited to, a printing fluid type, an out-of-fluid condition, and/or a printing fluid level.

Detector circuitry 44 may include a memory 46 and a processor 48 for comparing the supply signal and the detected signal to determine the measured impedance value. For example, memory 46 may be configured to store instructions executable by processor 48 to perform the comparison of the supply signal and detected signal to determine the measured impedance value. The instructions may also be executable by processor 48 to compare the measured impedance value to a plurality of predetermined impedance values correlated to specific printing fluid characteristics and arranged in a look-up table also stored in memory 46 to determine the desired characteristic of the printing fluid in conduit 28.

Figure 3:
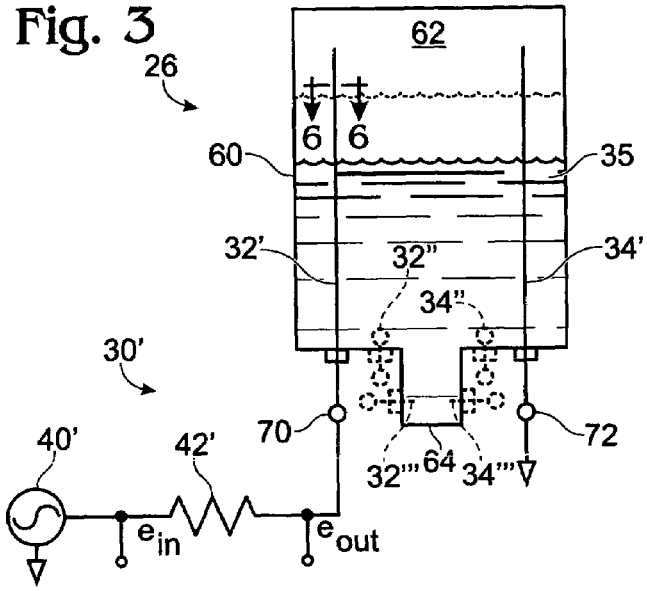
FIG. 3 is a schematic depiction of a second exemplary embodiment of the printing fluid detector of the printing device of FIG. 1, with the detector circuitry omitted.

FIG. 3 shows a schematic depiction of an exemplary embodiment of a printing fluid detector configured to be used as printing fluid detector 30' with printing fluid reservoir 26, or as printing fluid detector 30" with print head assembly reservoir 29. While FIG. 3 is described below in the context of printing fluid detector 30', it will be appreciated that the description is also applicable to printing fluid detector 30".

First, printing fluid reservoir 26 includes a body 60 defining an inner volume 62 configured to hold a volume of printing fluid 35, and an outlet 64 configured to pass printing fluid into conduit 28. Printing fluid reservoir 26 is depicted as being partially filled with printing fluid. However, it will be appreciated that printing fluid reservoir 26 typically begins a use cycle substantially completely filled with a printing fluid, and eventually transfers most or all of the printing fluid to print head assembly 12.

Next, printing fluid detector 30' includes a first electrode 32' and a second electrode 34' disposed within inner volume 62 of printing fluid reservoir 26. Printing fluid detector 30' also includes power supply circuitry 40' configured to apply an alternating signal to first 32' and second electrode 34'. A resistor 42' is disposed between power supply circuitry 40' and first electrode 32', in series with first electrode 32', second electrode 34' and printing fluid 35. Printing fluid detector 30' may also include suitable detector circuitry (not shown) to measure an applied signal at $e_{in}$ and a detected signal at $e_{out}$. Suitable detector circuitry includes, but is not limited to, detector circuitry 44 described above in reference to FIG. 2.

First electrode 32' and second electrode 34' may each have any suitable shape and size. For example, first electrode 32' and second electrode 34' may each have a plate-like configuration similar to that of a traditional capacitor, or a mesh-like configuration. Alternatively, first electrode 32' and second electrode 34' may have thin, needle-like or wire-like shapes. The terms "needle-like" and "wire-like" are used herein to denote an elongate configuration in which a long dimension of the electrode is substantially greater than two shorter directions orthogonal to the long dimension and to each other. The use of electrodes of these shapes is possible due to the large capacitances per unit surface area generated by the electrodes, as described in more detail below.

First electrode 32' and second electrode 34' may be coupled to body 60 in any suitable manner. In the depicted embodiment, first electrode 32' and second electrode 34' extend through body 60 of printing fluid reservoir 26 to a pair of external contacts, which are illustrated schematically in FIG. 3 as first contact 70 and second contact 72. Electrical contacts 70 and 72 may be configured to automatically form a connection with complementary contacts on printing device 10 (not shown) when printing fluid reservoir 26 is correctly mounted to printing device 10. This may enable printing fluid detector 30' to be easily connected to and disconnected from power supply 40', as well as any detector circuitry, during printing reservoir removal and/or replacement.

The electrodes may have other configurations and positions than those shown for electrodes 32' and 34'. For example, either of the electrodes, or each of the electrodes, may have a configuration that remains substantially covered by printing fluid until printing fluid reservoir 26 is substantially emptied of printing fluid. This is illustrated schematically via electrodes 32" and 34", which are shown in dashed lines as being disposed adjacent a bottom surface of printing fluid reservoir 26.

Additionally, either of, or both of, the first electrode and the second electrode may be disposed in outlet 64 of printing fluid reservoir 26, rather than within interior 62 of the printing fluid reservoir. This is illustrated schematically via electrodes 32''' and 34'''. In this configuration, essentially all of the printing fluid in printing fluid reservoir 26 may be emptied before electrodes 32''' and 34''' are exposed. Thus, placing electrodes 32''' and 34''' in outlet 64 may allow more printing fluid to be emptied from printing fluid reservoir 26 before the generation of an out-of-fluid signal than placing the electrodes on the bottom surface of the printing fluid reservoir. While electrodes 32''' and 34''' are disposed in outlet 64 the same distance from the bottom of outlet 64, it will be appreciated that electrodes 32''' and 34''' may also be disposed in the outlet at different distances from the bottom of the outlet.

As described above, first electrodes 32, 32', 32", and 32''' and second electrodes 34, 34', 34", and 34''' are configured such that the electrically conductive materials that form the electrodes are in direct contact with printing fluid when printing fluid is present. By placing the first electrode and the second electrode in direct contact with the printing fluid, extremely large capacitances may be formed. When two electrodes are placed in an ionic fluid, such as many printing fluids, and charged with opposite polarities, a layer of negative ions forms on the positively charged electrode, and a layer of positive ions forms on the negatively charged electrode. Furthermore, additional layers of positive and negative ions form on the innermost ion layers, forming alternating layers of oppositely charged ions extending outwardly into the printing fluid from each electrode. This charge structure is referred to as an electrical double layer (EDL), due to the double charge layer represented by the charges in the electrode and the charges in the first ion layer on the electrode surface.

Figure 4:
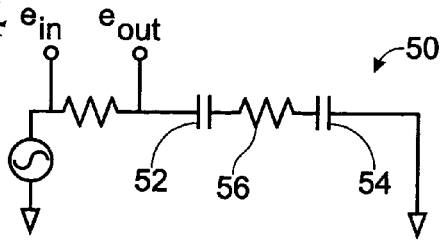
FIG. 4 is a schematic depiction of an equivalent circuit of the embodiments of FIGS. 2 and 3.

The EDL at each electrode acts effectively as a capacitor, wherein the layer of ions acts as one plate and the electrode acts as the other plate. The effective circuit of the electrodes in the solution is shown generally at 50 in FIG. 4, wherein capacitor 52 represents the EDL at first electrode 32, and capacitor 54 represents the EDL at second electrode 34. The printing fluid will also have an associated resistance, represented by resistor 56.

Due to the atomic-scale proximity of the ions to the electrode in the EDL, and to the fact that capacitance varies inversely with the distance of charge separation in a capacitor, extremely large capacitances per unit electrode surface area are generated in the EDLs associated with electrodes 32 and 34. The capacitances may be orders of magnitude larger than those possible with electrodes not in contact with the printing fluid. For example, where the surface areas and separation of first electrode 32 and second electrode 34 would be expected to result in a capacitance in the femptofarad range, capacitances in the nanofarad or microfarad range are observed. These large capacitances facilitate the measurement of the impedance of the printing fluid in printing fluid reservoir 26, conduit 28, and/or print head reservoir 29.

Likewise, when printing fluid is drained from between the first and second electrodes, much lower capacitances are observed. For example, where printing fluid is sufficiently drained such that printing fluid contacts only one electrode, or neither electrode, the EDL capacitance may be significantly reduced. Thus, in this instance, the capacitance of the first and second electrodes is lower than when both electrodes are in contact with printing fluid. The drop in capacitance may be easily distinguishable from noise. Thus, this difference in capacitance may be used to detect an out-of-fluid condition within conduit 28, and thus an out-of-fluid condition in printing fluid reservoir 26.

First electrode 32 and second electrode 34 may be made of any suitable electrically conductive material. Examples of suitable materials include, but are not limited to, metals such as stainless steel, platinum, gold and palladium. Alternatively, first electrode 32 and second electrode 34 may be made from an electrically conductive carbon material. Examples include, but are not limited to, activated carbon, carbon black, carbon fiber cloth, graphite, graphite powder, graphite cloth, glassy carbon, carbon felt, carbon aerogel, and cellulose-derived foamed carbon.

Where first electrode 32 and second electrode 34 are made of an electrically conductive carbon material, the material may be treated in any of a number of different ways to modify the physical characteristics of the material. For example, the carbon material may be heat treated at elevated temperatures in $N_2$, $O_2$ and/or water vapor. Such treatments may be used to change the density, electrical resistance, porosity, and/or the crystalline microstructure of the material, and/or to distill out impurities. For example, a liquid phase oxidation in an oxidizing acid may increase the surface area and porosity, lower the density, and increase the concentration of surface functional groups of the material. A gas-phase oxidation, such as heating in oxygen or water vapor, may be used for the same effects. On the other hand, a heat treatment in an inert environment, such as in nitrogen gas, may decrease the surface area and porosity, increase the density, and decrease the concentration of surface functional groups. A plasma treatment may be used for any number of effects, depending upon the gas mixture used in the plasma.

Figure 5:
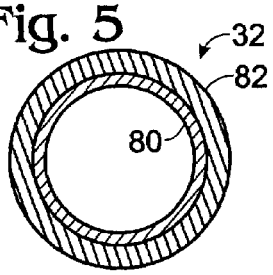
FIG. 5 is a magnified, cross-sectional view of an electrode of the embodiment of FIG. 2.
Figure 6:
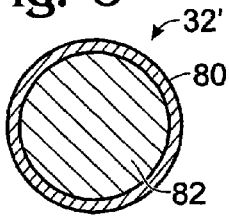
FIG. 6 is a magnified, cross-sectional view of an electrode of the embodiment of FIG. 3.

In some embodiments, first electrode 32 and second electrode 34 may be coated with an electrically conductive coating. FIG. 5 shows a cross-section of an exemplary embodiment of first electrode 32 of FIG. 2 having an electrically conductive coating 80 disposed on an inner surface of an electrode substrate 82. Likewise, FIG. 6 shows a cross-section of an exemplary embodiment of first electrode 32' of FIG. 3 having an electrically conductive coating 80' disposed on an outer surface of an electrode substrate 82'. Although the conductive coatings are described below in the context of electrode 32, it will be appreciated that the discussion also applies to electrodes 32', 32" and 32'" of FIG. 3.

Electrode substrate 82 is typically made at least partially of one of the conductive metal or carbon materials listed above (or any other material with a comparable electrical conductivity), and functions as the primary electrical conductor of the electrodes. Electrically conductive coating 80 is typically made of a polymer material, and functions to increase the effective surface area (and thus the capacitance) of electrode substrate 82, and/or to protect the electrode substrate from the printing fluid. Thus, the material from which coating 80 is made may be selected either for its resistance to the printing fluid, and/or for its porosity/permeability to the printing fluid.

Where coating 80 is configured to increase the effective surface area of an electrode, the coating may be made of a polymer having a porous macrostructure or microstructure that is permeable by printing fluid and/or by ions in the printing fluid. Examples of such polymers include, but are not limited to, polypyrroles, polyanilines, polythiophenes, conjugated bithiazoles and bis-(thienyl) bithiazoles. BAYTRON-P, which is a trade name for an aqueous dispersion of poly(3,4-ethylenedioxythiophene) poly(styrenesulfonate) sold by H. C. Starck Electronic Chemicals, Inc. of Newton, Mass., is another example of a suitable material for coating 80. BAYTRON-P may be applied by dip-coating or spray-coating followed by a heat-treatment, or may be applied in any other suitable manner.

Figure 7:
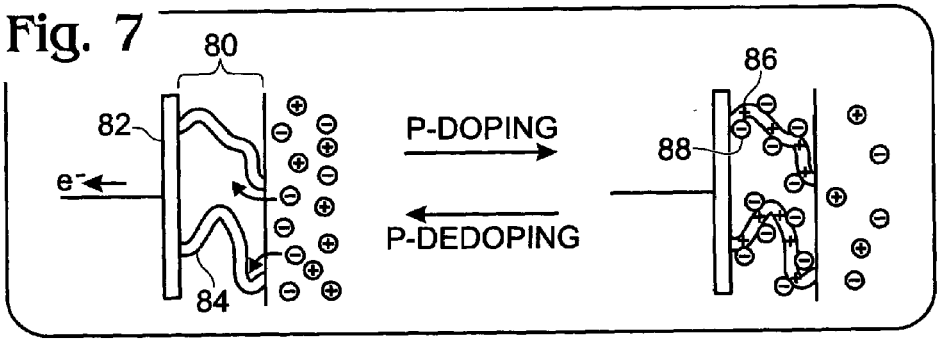
FIG. 7 is a schematic depiction of a p-type charge/discharge cycle of the electrically conductive coating of the electrodes of FIGS. 5 and 6.

FIG. 7 shows a schematic depiction of a coating 80 made of a polymer configured to increase the electrode surface area. Electrode substrate 82 is depicted as a capacitor plate, and coating 80 is depicted as a layer in contact with the substrate containing a plurality of polymer chains 84. Polymer chains 84 are depicted as being attached at one end to electrode substrate 82. However, the polymer chains 84 may be attached to electrode substrate 82 in any other suitable manner. Side chains, functional groups, etc. attached to polymer chains 84 are omitted for clarity.

Polymer chains 84 are typically characterized by a large degree of π-orbital conjugation that give rise to electrical conductivity, and/or an ability to be electrochemically oxidized or reduced by charge injection or withdrawal at the interface with electrode substrate 82. These oxidation and/or reduction reactions may demonstrate mirror-image cyclic voltammograms, indicating that the reactions may be easily reversible.

A p-type charge-discharge cycle is also illustrated in FIG. 7. On the left side of FIG. 7, electrons are shown as being withdrawn from polymer chains 84. This occurs when the power supply applies a positive bias to electrode substrate 82. The withdrawal of electrons results in the formation of positive charges along the polymer chain, as indicated at 86 at the right side of FIG. 7. The positive charges attract negative ions 88 from the printing fluid. Thus, an EDL builds along each polymer chain, as well as along electrode substrate 82 where it is accessible to the ions and/or printing fluid.

Figure 8:
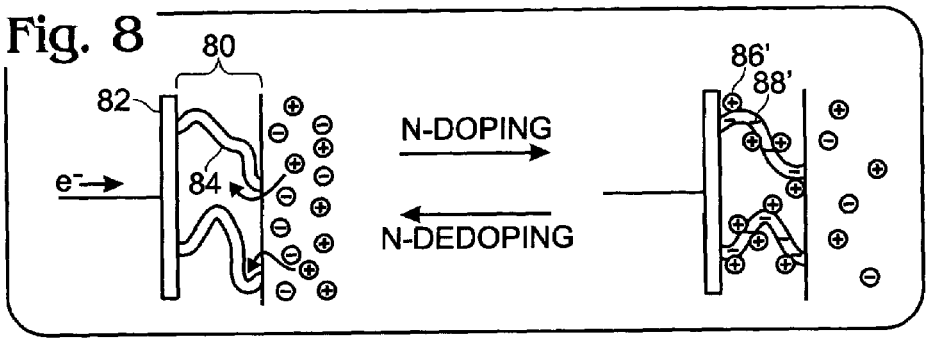
FIG. 8 is a schematic depiction of an n-type charge/discharge cycle of the electrically conductive coating of the electrodes of FIGS. 5 and 6.

FIG. 8 demonstrates an n-type charge-discharge cycle. This charge-discharge cycle occurs when the power supply applies a negative bias to electrode substrate 82. On the left side of FIG. 8, electrons are shown being injected into polymer chains 84. The injection of electrons results in the formation of negative charges 88' along polymer chains 84, which attracts positive ions 86' from the printing fluid. Thus, an EDL (of the opposite polarity as the p-type charge/discharge cycle) builds up along polymer chains 84.

Due to the length of each polymer chains 84 relative to the amount of electrode substrate 82 surface area occupied and/or sterically hindered by the polymer chains, the presence of the polymer chains may greatly increase the amount of surface area of the electrodes available for charge storage compared to an uncoated electrode, and thus may greatly increase the capacitance of the electrodes.

Figure 9:
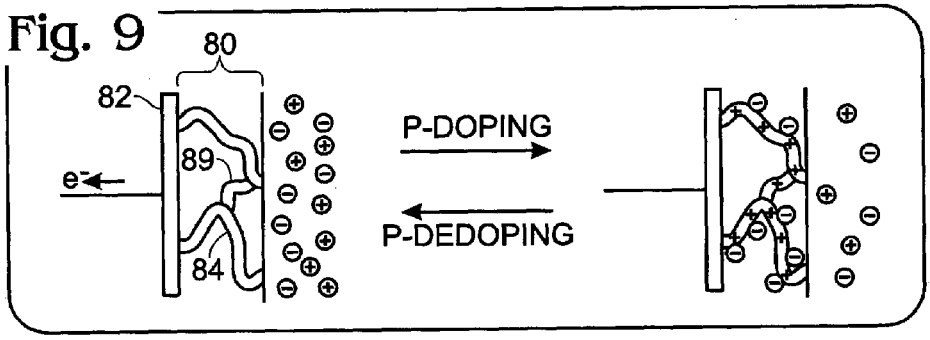
FIG. 9 is a schematic depiction of a p-type charge/discharge cycle of the electrically conductive coating of the electrodes of FIGS. 5 and 6, after being cross-linked.

Furthermore, coating 80 may be selectively crosslinked to reduce the level and type of adsorbed printing fluid components. This is illustrated in FIG. 9, where a crosslinking polymer chain 89 is shown connecting adjacent polymer chains 84. Coating 80 may be crosslinked for various reasons. For example, crosslinking may be used to make the microstructure of coating 80 less porous and/or accessible to the printing fluid and/or ions in the printing fluid to decrease the capacitance of the electrode. Likewise, the material used for crosslinking coating 80 may be configured to disrupt the Tr-orbital conjugation of polymer chains 84, which also may decrease the capacitance of the electrode. The decrease in the porosity/permeability of coating 80 to printing fluid caused by crosslinking may also help to protect electrode substrate 82 from attack and corrosion by the printing fluid.

Coating 80 may be crosslinked in any suitable manner. Examples include, but are not limited to, reactions between polymer chains 84 and standard crosslinking agents such as epoxides, dienes, acrylates, and isocyanates.

Coating 80 may be configured to perform other functions besides increasing the surface area of the electrodes. For example, coating 80 may be configured to protect electrode substrate 82 from corrosion by the printing fluid. Examples of suitable electrically conductive protective coatings include, but are not limited to, carbon-containing TEFLON coatings, and other fluorine-containing polymers such as fluoro-siloxanes. Furthermore, the electrically conductive, surface area-increasing polymers discussed above in the context of FIGS. 7–9 may be crosslinked to provide protection to electrode substrate 82 from printing fluids.

Figure 10:
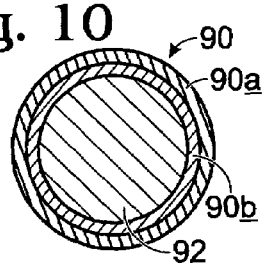
FIG. 10 is a magnified, cross-sectional view of an alternate electrode of the embodiment of FIG. 3

If desired, more than one coating may be used on the electrodes. FIG. 10 shows a cross-sectional depiction of a dual-layer coating 90 disposed over an electrode substrate 92. Coating 90 includes an inner protective layer **90*a*, and an outer, surface area-increasing layer 90*b*. Inner protective layer 90*a* may be made from any of the above-described protective layers, while outer layer 90*b* may be made from any suitable surface area-increasing material that is capable of adhering to inner protective layer 90*a* with sufficient strength to withstand repeated charge-discharge cycles. The double layer structure of coating 90 both helps to protect electrode substrate 90** from corrosion by the printing fluid, and also helps increase the surface area of the electrode for increased electrode capacitance.

Figure 11:
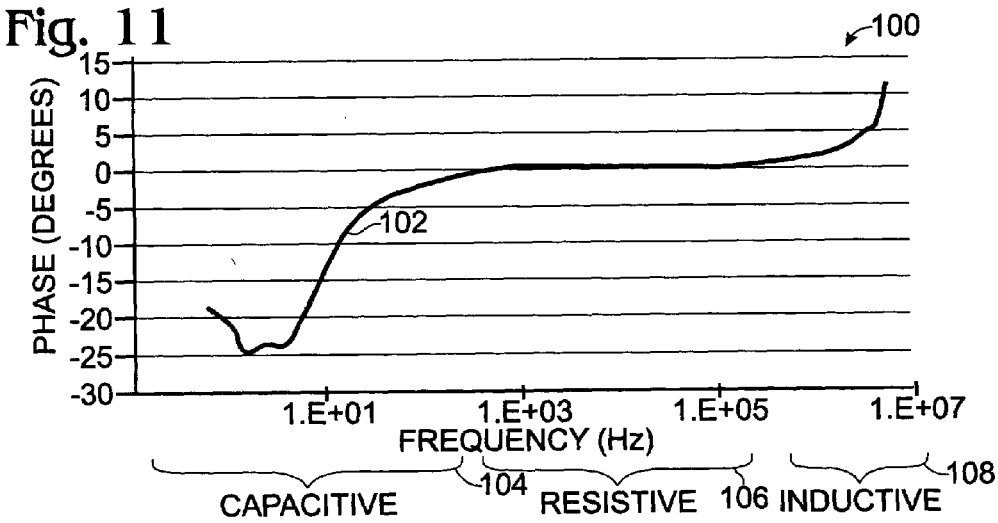
FIG. 11 is a graph showing a measured phase shift between $e_{in}$ and $e_{out}$ of the embodiments of FIGS. 2 and 3 as a function of signal frequency.
Figure 12:
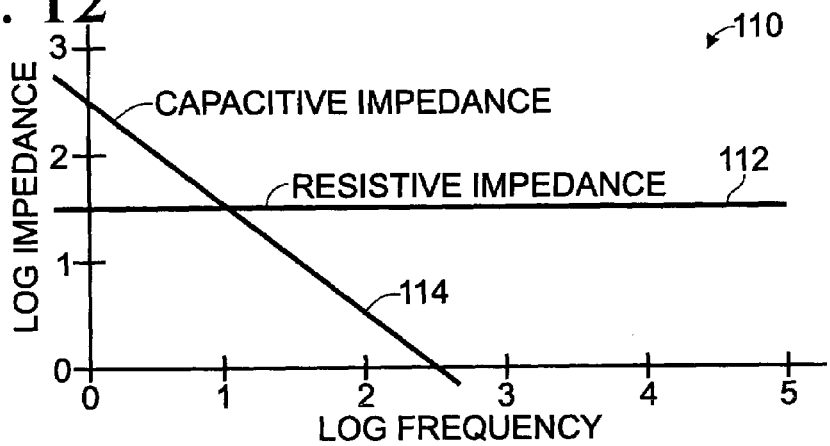
FIG. 12 is a log-log graph showing the relative contributions of capacitance and resistance to the total impedance of the embodiments of FIGS. 2 and 3 as a function of signal frequency.

FIG. 11 shows, generally at 100, a graph depicting the observed phase shift of a signal in an exemplary printing fluid detector as a function of the log of the frequency of the signal. The data represented in graph 100 was taken from a printing fluid detector full of fluid. Line 102 is drawn through a plurality of data points (not shown) taken over a range of frequencies from approximately 1 Hz to approximately 1 MHz. The phase shift shows a first region 104 between approximately 1 Hz and approximately 1 kHz in which the phase shift varies significantly as a function of the frequency of the supply signal. Referring to FIG. 12, which shows a graph 110 illustrating the frequency dependence of the resistive component of the total impedance of the electrodes and printing fluid at 112 and the capacitive portion of the total impedance at 114, it can be seen that the capacitive portion dominates the total impedance at lower frequencies. Thus, the phase shift of the detected signal compared to the supply signal is expected to be greatest in this region.

Referring again to FIG. 11, the phase shift is seen to be essentially zero in a second, middle region 106 of graph 100, between approximately 1 kHz and 100 kHz. In this region, the capacitive and inductive portions of the impedance are negligible, while the resistive portion is dominant. Finally, the phase shift increases in a third, high-frequency region 108 of graph 100, above approximately 100 kHz. This phase shift is due to inductive effects. Thus, the capacitance of the printing fluid within conduit 28 may be measured most sensitively in capacitive frequency region 104, between approximately 1 Hz and 1 kHz. While the phase shift is expected to be greatest at low frequencies, the use of frequencies in the range of 50–100 Hz still give large phase shifts, and also may enable the more rapid acquisition of data. Furthermore, the use of lower frequencies (<1 Hz) may result in the plating of the electrodes with metal ions present in the printing fluid, whereas the use of higher frequencies may avoid problems with plating.

Because the total capacitance of first electrode 32 and second electrode 34 is a function of the amount of charge stored on each electrode, the capacitance of the electrodes drops as the fluid level (and thus the size of each EDL) drops. This drop is relatively large where one of the electrodes is not in contact with printing fluid. Thus, an absence of printing fluid in conduit 28 may be observed as a relatively significant change in the phase shift between the supply signal measured at $e_{in}$ and the detected signal measured at $e_{out}$.

Figure 13:
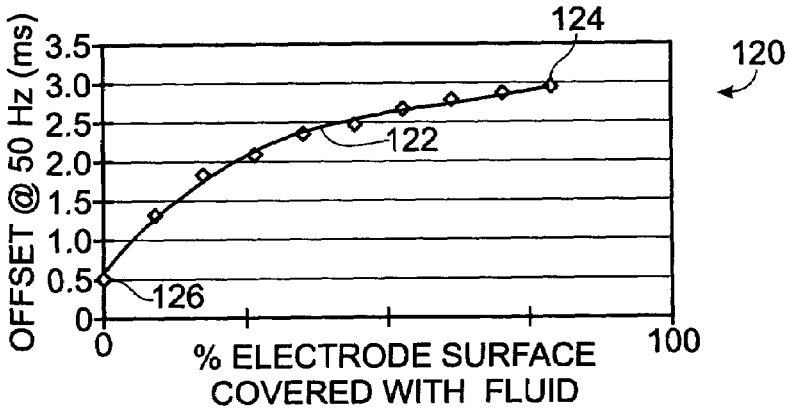
FIG. 13 is a graph showing a measured phase shift between $e_{in}$ and $e_{out}$ as a function of an amount of printing fluid between the electrodes of the embodiments of FIGS. 2 and 3.

FIG. 13 shows, generally at 120, a graph depicting the dependence of the phase shift (via line 122) between the supply signal and the detected signal as a function of an amount of electrode surface area covered by printing fluid. Graph 120 shows the result of experiments performed with two electrodes in a vessel of printing fluid, but the graph may be used to extrapolate capacitances observed between a full-of-fluid condition and an out-of-fluid condition in conduit 28. The full-of-fluid condition corresponds to point 124, which shows a phase shift of approximately 3.0 ms, while an out-of-fluid condition corresponds approximately to point 126, which shows a phase shift of approximately 0.5 ms.

The magnitude of the phase shift at these printing fluid levels has been found to be accurately reproducible. This enables a look-up table of phase shifts associated with an absence or presence of printing fluid to be constructed and stored in memory 48. Thus, processor 46 may be programmed to match a measured phase shift value to phase shift values stored in the look-up table in memory 48 for both the "full of fluid" and out-of-fluid conditions, and then to determine the printing fluid level corresponding to the measured phase shift value. Processor 46 may then communicate this condition to printing device controller 22, which may stop printing or take other suitable action in response. Alternatively, a simple threshold filter circuit may be used to detect an out-of-fluid signal without the use of a look-up table, wherein capacitances above a preselected threshold value are considered to indicate the presence of printing fluid, and capacitances below the preselected threshold value (or a separate, lower preselected value) are considered to indicate the absence of printing fluid.

Figure 14:
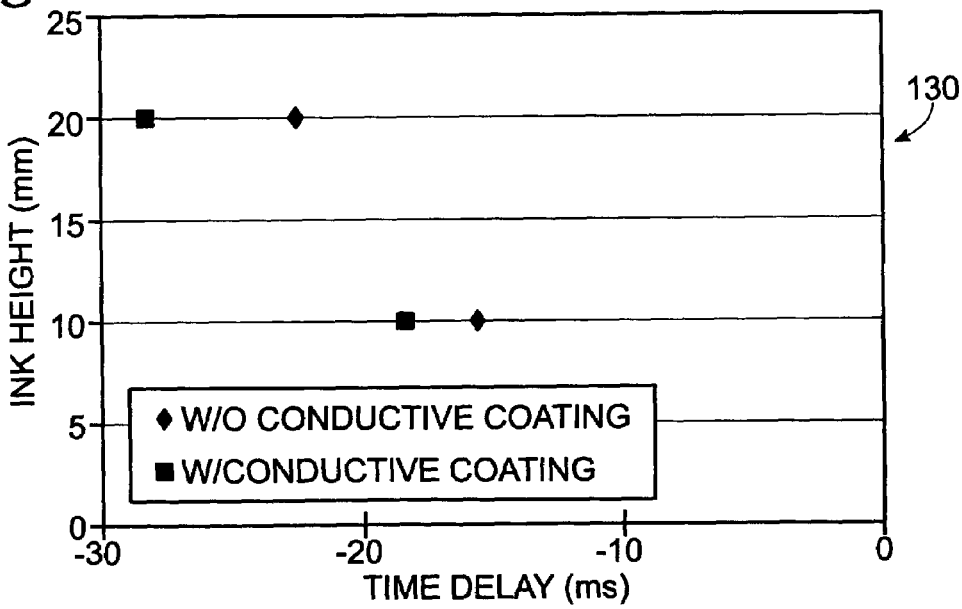
FIG. 14 is a graph showing a comparison of the phase shifts observed for two different printing fluid levels in the presence and absence of the electrically conductive electrode coating of the embodiments of FIGS. 2 and 3.

FIG. 14 shows a graph 130 illustrating a difference in observed phase shifts between a pair of electrodes coated with BAYTRON-P and a pair of electrodes (of otherwise equal shape and size) not coated with a surface area-increasing polymer coating. First, at a printing fluid height of 10 millimeters, the electrodes with the BAYTRON-P coating show a phase shift of approximately 4 milliseconds greater than the uncoated electrodes. Next, at a printing fluid height of 20 millimeters, the electrodes having the BAYTRON-P coating show a phase shift of approximately 6–7 milliseconds greater than the uncoated electrode pair. Thus, the use of the surface area-increasing conductive polymer coating clearly increases the capacitance of an electrode pair relative to an uncoated electrode pair, and thus allows greater measurement sensitivities to be realized.

Although the present disclosure includes specific embodiments, specific embodiments are not to be considered in a limiting sense, because numerous variations are possible. The subject matter of the present disclosure includes all novel and nonobvious combinations and subcombinations of the various elements, features, functions, and/or properties disclosed herein. The following claims particularly point out certain combinations and subcombinations regarded as novel and nonobvious. These claims may refer to "an" element or "a first" element or the equivalent thereof. Such claims should be understood to include incorporation of one or more such elements, neither requiring nor excluding two or more such elements. Other combinations and subcombinations of features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

What is claimed is:

1. A printing device configured to print a printing fluid onto a printing medium, the printing device comprising:

a printing fluid reservoir configured to hold a volume of the printing fluid;

a print head assembly configured to transfer the printing fluid to the printing medium, wherein the print head assembly is fluidically connected to the printing fluid reservoir; and a printing fluid detector configured to detect a characteristic of the printing fluid, wherein the printing fluid detector includes a first electrode and a second electrode configured to be in contact with the printing fluid, wherein at least one of the first electrode and the second electrode provides a hollow interior that the printing fluid passes through and includes an electrically conductive coating disposed on an inner surface of the hollow interior and over an electrically conductive substrate, and wherein the electrically conductive coating is permeable to printing fluid.

2. A printing device configured to print a printing fluid onto a printing medium, the printing device comprising:

a printing fluid reservoir configured to hold a volume of the printing fluid;

a print head assembly configured to transfer the printing fluid to the printing medium, wherein the print head assembly is fluidically connected to the printing fluid reservoir; and a printing fluid detector configured to detect a characteristic of the printing fluid, wherein the printing fluid detector includes a first electrode and a second electrode configured to be in contact with the printing fluid, and wherein at least one of the first electrode and the second electrode provides a hollow interior that the printing fluid passes through and includes an electrically conductive coating made at least partially from an electrically conductive polymer, and disposed on an inner surface of the hollow interior and over an electrically conductive substrate.

3. The printing device of claim 2, wherein the electrically conductive polymer is selected from the group of electrically conductive polymers consisting of polypyrroles, polyanilines, polythiophenes, conjugated bithiazoles and bis-(thienyl) bithiazoles.

4. The printing device of claim 2, wherein the electrically conductive polymer is cross-linked.

5. A printing device configured to print a printing fluid onto a printing medium, the printing device comprising:

a printing fluid reservoir configured to hold a volume of the printing fluid;

a print head assembly configured to transfer the printing fluid to the printing medium, wherein the print head assembly is fluidically connected to the printing fluid reservoir, and a printing fluid detector configured to detect a characteristic of the printing fluid, wherein the printing fluid detector includes a first electrode and a second electrode configured to be in contact with the printing fluid, and wherein at least one of the first electrode and the second electrode provides a hollow interior that the printing fluid passes through and includes an electrically conductive coating resistant to corrosion by printing fluid, the coating disposed on an inner surface of the hollow interior and within an electrically conductive substrate.

6. The printing device of claim 5, wherein the electrically conductive coating is a protective polymer coating, further comprising a printing fluid-permeable electrically conductive polymer coating disposed over the protective polymer coating.

7. The printing device of claim 6, wherein the printing fluid-pemieable electrically conductive polymer coating is made at least partially of a material selected from the group consisting of polypyrroles, polyanilines, polythiophenes, conjugated bithiazoles and bis-(thienyl) bithiazoles.

8. A printing device configured to print a printing fluid onto a printing medium, the printing device comprising:

a printing fluid reservoir configured to hold a volume of the printing fluid;

a print head assembly configured to transfer the printing fluid to the printing medium, wherein the print head assembly is in fluid communication with the printing fluid reservoir; and a printing fluid detector configured to detect a characteristic of the printing fluid, wherein the printing fluid detector includes a first electrode and a second electrode configured to be in contact with the printing fluid, wherein at least one of the first electrode and the second electrode provides a hollow interior that the printing fluid passes through and includes an electrically conductive coating permeable to printing fluid, the coating disposed on an inner surface of the hollow interior and over an electrically conductive substrate, and wherein the electrically conductive coating includes a plurality of interior surfaces contactable by the printing fluid.

9. The printing device of claim 8, wherein the electrically conductive coating is porous.

10. A printing device configured to print a printing fluid onto a printing medium, the printing device comprising:

a printing fluid reservoir configured to hold a volume of the printing fluid;

a print head assembly configured to transfer the printing fluid to the printing medium, wherein the print head assembly is in fluid communication with the printing fluid reservoir; and a printing fluid detector configured to detect a characteristic of the printing fluid, wherein the printing fluid detector includes a first electrode and a second electrode configured to be in contact with the printing fluid, and wherein at least one of the first electrode and the second electrode provides a hollow interior that the printing fluid passes through and includes an electrically conductive coating at least partially made of a polymer that is permeable to the printing fluid, the electrically conductive coating being disposed on an inner surface of the hollow interior and within an electrically conductive substrate.

11. The printing device of claim 10, wherein the polymer is selected from the group consisting of polypyrroles, polyanilines, polythiophenes, conjugated bithiazoles and bis-(thienyl) bithiazoles.

12. The printing device of claim 10, wherein the polymer is cross-linked.

13. A printing device configured to print a printing fluid onto a printing medium, the printing device comprising:

a printing fluid reservoir configured to hold a volume of the printing fluid;

a print head assembly configured to transfer the printing fluid to the printing medium, wherein the print head assembly is in fluid communication with the printing fluid reservoir;

a printing fluid detector configured to detect a characteristic of the printing fluid, wherein the printing fluid detector includes a first electrode and a second electrode configured to be in contact with the printing fluid, and wherein at least one of the first electrode and the second electrode includes provides a hollow interior that the printing fluid passes through and an electrically conductive coating permeable to printing fluid, wherein the permeable coating is disposed on an inner surface of the hollow interior and within an electrically conductive substrate; and an electrically conductive protective coating disposed between the electrically conductive substrate and the electrically conductive coating permeable to printing fluid, wherein the protective coating is at least partially made of a TEFLON material.

14. A printing device configured to print a printing fluid onto a printing medium, the printing device comprising:

a printing fluid reservoir configured to hold a volume of the printing fluid;

a print head assembly configured to transfer the printing fluid to the printing medium, wherein the print head assembly is fluidically connected to the printing fluid reservoir; and a printing fluid detector configured to detect a characteristic of the printing fluid, wherein the printing fluid detector includes a first electmde and a second electrode configured to be in contact with the printing fluid, wherein at least one of the first electrode and the second electrode provides a hollow interior that the printing fluid passes through and includes an electrically conductive coating disposed over an electrically conductive substrate, and wherein the electrically conductive coating is permeable to printing fluid and is configured to increase the effective surface area of the electrode accessible to the printing fluid.

* * * * *